United States Patent [19]

Schwadtke et al.

[11] 4,139,475

[45] Feb. 13, 1979

[54] LAUNDRY FINISHING TREATMENT AGENT PACKAGE AND METHOD

[75] Inventors: Karl Schwadtke, Opladen; Rudolf Weber, Dusseldorf-Holthausen; Werner Künzel, Langenfeld, all of Fed. Rep. of Germany

[73] Assignee: Henkel Kommanditgesellschaft auf Aktien, Dusseldorf-Holthausen, Fed. Rep. of Germany

[21] Appl. No.: 816,921

[22] Filed: Jul. 19, 1977

[30] Foreign Application Priority Data

Aug. 5, 1976 [DE] Fed. Rep. of Germany ..... 2635257

[51] Int. Cl.[2] ..... D06M 13/34

[52] U.S. Cl. ..... 252/8.6; 8/115.6; 68/17 R; 206/0.5; 252/8.8

[58] Field of Search ..... 252/8.6, 8.8; 8/115.6 A; 206/0.5; 68/17 R

[56] References Cited

U.S. PATENT DOCUMENTS

| | | | |
|---|---|---|---|
| 3,944,694 | 3/1976 | McQueary | 428/136 |
| 3,947,971 | 4/1976 | Bauer | 206/0.5 |
| 3,956,556 | 5/1976 | McQueary | 428/136 |
| 3,989,631 | 11/1976 | Marsen | 252/8.8 |
| 3,989,638 | 11/1976 | Bradley et al. | 252/186 |
| 4,004,685 | 1/1977 | Mizuno et al. | 206/0.5 |
| 4,014,432 | 3/1977 | Clothier et al. | 206/0.5 |

*Primary Examiner*—William E. Schulz
*Attorney, Agent, or Firm*—Hammond & Littell

[57] ABSTRACT

A laundry finishing treatment agent in package form for use in a mechanical laundry drier comprising a paste of effective substances of the fabric softening type, textile antistatic type, disinfectant type and, optionally, odorants mixed with a liquid, in a package of film material having a pillow-like form with one side impermeable to said effective substance and the other side having a plurality of slits therein.

17 Claims, 5 Drawing Figures

FIG. 1a
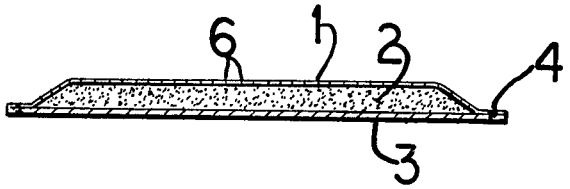
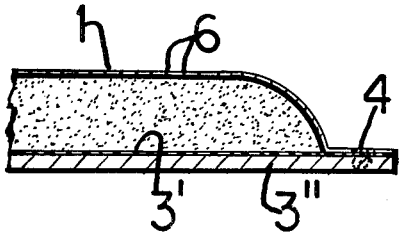
FIG. 1b
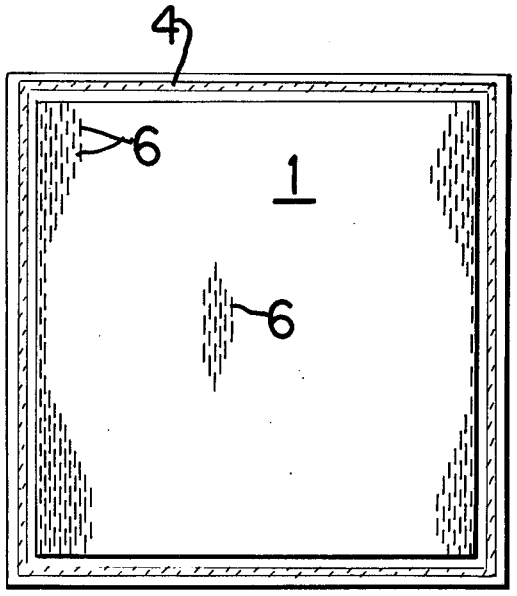
FIG. 2

FIG. 3
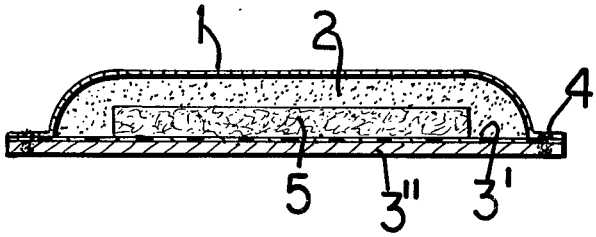
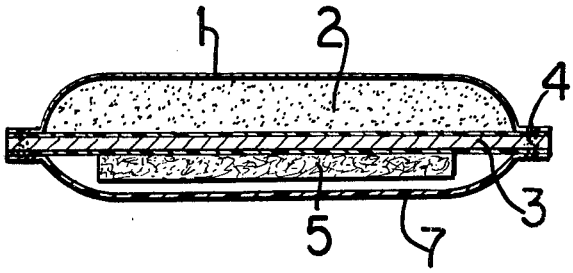
FIG. 4
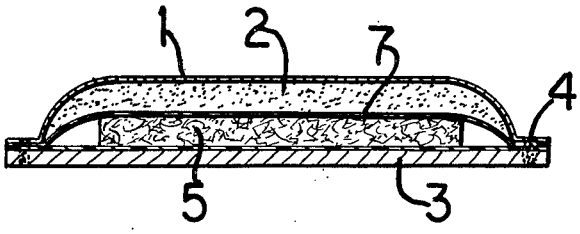
FIG. 5

LAUNDRY FINISHING TREATMENT AGENT PACKAGE AND METHOD

BACKGROUND OF THE ART

During the washing process of laundry in mechanical washing machines the laundry is first washed with water containing detergent and then drained and rinsed one or several times with rinse water. This rinse treatment is usually of a short duration. During this rinsing treatment use is frequently made, particularly in the last rinse step, of agents which are intended to impart improved properties to the washed laundry, such as a soft and fleecy feel, antistatic behavior, an antimicrobe protection and a pleasant smell. In order to be suitable for these finishing treatment methods, these agents must not only become uniformly distributed in the cold rinsing bath, but also become exhausted in a short time from the bath onto the textiles. Useful products are indeed on the market, which impart to the laundry in the last rinsing bath the desired, predominantly softening and antistatic properties, but all the items of laundry are uniformly affected by this type of treatment, so that the laundry must be sorted out already before washing with a view toward the finishing treatment. Moreover, care must be taken with this method that the finishing treatment agent is introduced into the washing machine at the correct time or through a special metering device and without contact with the actual washing agent.

A further disadvantage of the known laundry finishing treatment agents is that they can be made up only as highly diluted, aqueous suspensions, since stability during storage, ease of pouring and rapid distribution in the cold rinsing water is assured only when the effective substances are present in a dilution of 10 to 20 times, which leads to relatively high costs for packaging and transportation. Substances which are insoluble in cold water are just as poorly suited for this kind of laundry treatment as those which possess no specific affinity for the textile fiber surface, are poorly exhausted from the rinse water and, consequently, with the used rinsing water, are passed to the sewer system. Therefore, the number of usable effective substances is limited.

With the steadily increasing use of laundry drying machines in industrial laundries and in private households, because of the saving in space and time in laundry drying afforded by such use by comparison with hanging the laundry on a line to dry, new possibilities now arise for moving the process of laundry finishing treatment to the drier itself and carrying it out simultaneously with the drying of the laundry. Recently, a series of proposals have, therefore, been made as to how known and new effective substances can be applied to the finishing treatment of laundry in the laundry drier. Among these proposals are the use of textile or paper webs which are impregnated with the effective substance, and the use of foaming or non-foaming aerosol mixtures, with which the effective substances are sprayed onto the internal wall of the drier or onto the moist textile articles.

Furthermore, the use of perforated hollow objects, which contain a solution of the effective substance and which are tumbled in the laundry drier together with the laundry, and of solid, pelletized mixtures of the effective substances with soluble carrier substances, which are to be absorbed during the drying process onto the textile surface, has also been discussed. These forms of application of the state of the art are, however, accompanied by a series of disadvantages. Thus, for example, a non-uniform distribution and a consequent forming of stains on the laundry are observed in the use of solid textile softeners. Even with the perforated hollow articles filled with liquid finishing treatment agents, the problem of the uniform distribution of the effective substances is not solved, added to which are the further disadvantages of the cumbersomeness of these articles and the difficulty of metering the effective substances. With the use of the agent in spray form, undesired precipitations frequently form on the equipment parts important for correct functioning of the laundry drier equipment, such as, for example, the temperature and humidity sensors. With the sheets of paper, woven or non-woven fabric impregnated with the effective substance, it is to be observed that the effective substance adhering to the substrate, which should become detached from the substrate and absorbed onto the textile to be dried, is only incompletely given off, which also imposes a limit upon the effectiveness of this form of application.

U.S. Pat. No. 3,701,202 discloses another method of distributing liquid textile treating agents in a drum dryer which comprises a container with a porous outlet which is clamped in the rotatable drum. This likewise creates problems of uneven distribution of the treating agents and involves the additional problem of detaching and replacing the container after each operation or after several operations, in order to fill the same.

Another commercial development of the same nature is the use of a porous container which has a self-adhering side, which is attached to the wall of the dryer drum. This type of device presents the problem of even application of the treating agents to the goods, particularly since the commercial embodiment is designed to be used over a series of drier cycles.

U.S. Pat. No. 3,989,638 likewise is directed to the problem and discloses the use of articles releasably containing starch-thickened peroxygen bleaches for use in machine laundry driers. Patentee employs articles having perforations in the range of 0.05 to about 3 mm in order that his thickened bleaches can be released at the proper rate, since moisture must be present to effect the bleaching action. This device suffers the drawback that the amount of bleach being dispensed at the onset will depend on the temperature of the bleach package storage since the viscosity of the starch thickened bleach is dependent on viscosity. Moreover, such an article must be covered until the time of use and care must be taken to avoid loss of bleach from the article before inserting the same into the dryer.

OBJECTS OF THE INVENTION

An object of the present invention is the development of a laundry finishing treatment agent which is suitable for use in a mechanical laundry drier and in the form of a dispensing device charged with effective substances.

Another object of the present invention is the development of a laundry finishing treatment agent for use in a mechanical laundry drier comprising a paste of at least one effective substance selected from the group consisting of:

(1) textile fabric softeners,
(2) textile antistatic agents,
(3) mixtures of (1) and (2),
(4) mixtures of (1) or (2) or both with a disinfectant agent, (5) mixtures of (1) or (2) or both with a laundry odorant, and (6) mixtures (1) or (2) or both with a disinfectant agent and a laundry odorant, said at least one effective substance being present in an amount sufficient to treat the average laundry processed in said mechanical laundry drier and being mixed with a liquid to give said paste, contained in an article of film material having a pillow-like form with one side impermeable to said paste of said effective substance and the other side being a plastic film having a plurality of slits therein of such dimensions, that at room temperature and in the absence of pressure on said article, said slits are substantially closed and obstruct the issuance of said paste from said article.

These and other objects of the invention will become more apparent as the description thereof proceeds.

THE DRAWINGS

FIG. 1*a* is a cross-section of the pillow-like article containing a paste of effective substances of the invention.

FIG. 1*b* is a detail of one embodiment of FIG. 1*a*.

FIG. 2 is a top view of the pillow-like article of the invention depicting the rectilinear slits.

FIG. 3 is a cross-section of another embodiment of the pillow-like article of the invention containing both a paste of effective substances and a solid absorbent having a laundry odorant absorbed thereon.

FIG. 4 is a cross-section of another embodiment of the pillow-like article of the invention wherein the solid absorbent having a laundry odorant absorbed thereon is maintained physically apart from the paste of effective substances and enclosed by a gas-permeable film.

FIG. 5 is a cross-section of another embodiment of the pillow-like article of the invention comparable to FIG. 4.

DESCRIPTION OF THE INVENTION

According to the present invention, there is now provided an agent for the finishing treatment of washed laundry in a mechanical laundry drier, the agent comprising a paste of effective substances mixed with a liquid and being contained in a bag of film material, the bag having a front side with a plurality of slits therein and a rear side impermeable to the effective substances, and the front side and the rear side of the bag being bonded together at edge portions thereof.

More particularly, the present invention relates to a laundry finishing treatment agent for use in a mechanical laundry drier comprising a paste of at least one effective substance selected from the group consisting of:

(1) textile fabric softeners, (2) textile antistatic agents, (3) mixtures of (1) and (2), (4) mixtures of (1) and (2) or both with a disinfectant agent, (5) mixtures of (1) or (2) or both with a laundry odorant, and (6) mixtures of (1) or (2) or both with a disinfectant agent and a laundry odorant, said at least one effective substance being present in an amount sufficient to treat the average laundry processes in said mechanical laundry drier and being mixed with a liquid to give said paste, contained in an article of film material having a pillow-like form with one side impermeable to said paste of said effective substance and the other side being a plastic film having a plurality of slits therein of such dimensions, that at room temperature and in the absence of pressure on said article, said slits are substantially closed and obstruct the issuance of said paste from said article.

This agent is introduced into the laundry drier together with the laundry still moist from washing and is there agitated together with the laundry during the drying process. Surprisingly, it has been observed that when the agent is added in the laundry drier to the laundry still moist from washing, the effective substances content is delivered uniformly to the laundry during the drying process and the desired characteristics are thereby more readily imparted to the dried articles.

It was further observed that the slit side of the bag can be so constructed in regard to length, shape and arrangement of the slits and also as to the thickness of the film with slits, that it behaves virtually like a closed surface at room temperature and in the absence of applied pressure, while under the influence of the laundry moved in the laundry drier and the heat prevailing there, the slits open and gradually release the effective substance.

It was also observed that the mechanical action on the film bag is at its most intensive at the start of the drying process, since the laundry is then still heavy with the moisture. By adapting the consistency of the aqueous effective substance paste to the form of the slits in the film and to their thickness, it is attainable that a large part of the effective substance issued from the bag already in this initial phase. The uniform distribution of the effective substance onto the fibrous surface is promoted by the moisture then still present in the textiles.

It was furthermore observed that the use of the effective substance as a paste makes possible a more uniform and substantially complete distribution and utilization of the effective substances than is attainable when using the effective substances in solid form according to the state of the art, be it in a mixture with soluble carrier substances, such as, for example, urea or ammonium carbonate, or on porous carriers of paper or non-woven fabric.

Rapid and uniform distribution of the effective substances are required where the same are textile fabric softeners and/or textile antistatic agents, either with or without disinfectant agents or antimicrobials. However, rapid distribution of any laundry odorant present is not as desirable since prolonged exposure of the usual laundry odorants to heat and moisture results in a large loss of the same due to evaporation and possibly a type of steam distillation. Therefore, in a preferred embodiment the odorant is incorporated into a solid absorbent which releases the same gradually. This odorant incorporated into a solid absorbent may be present in the same area as the paste of effective substances, as depicted in FIG. 3 or may be liquid, but not gas, impermeably sealed therefrom as depicted in FIGS. 4 and 5.

The film bag is preferably constructed in cushion-shape or pillow-like form, with edge portions thereof bonded together around the periphery of the cushion. Suitable materials for the front side of the film bag are plastic films, especially films of polyethylene. Preferably the films of polyethylene should be 0.15 to 0.5 mm thick. The number of slits in the front side of the bag is in itself arbitrary. It has, however, proved that polyethylene films with 4 to 20, especially such with 6 to 10, slits per square centimeter are particularly suitable. For the rear side, which is to be impermeable to the effective substances, to water and to perfume oils, an appropriately thick plastics film or a foil of metal such as, for example, aluminum or tin, is suitable. Particularly preferred is a rear side of a two-layer film, the one layer of which is of a weldable plastics material, especially of polyethylene, while the other layer is of a metal foil, since a simple manufacture of the film bag is possible with such a film by welding the forward and rear sides together.

Shape and arrangement of the slits in the film are in themselves arbitrary. Apart from the preferred, rectilinear slits, slits of zig-zag or undulating shape or curved to semi-circular slits may, for example, also be provided. Particularly preferred are slits of rectilinear shape which are arranged in parallel rows where the slits are staggered to one another.

Preferably, the film selected for the formation of the front side is a polyethylene film of a thickness of 0.25 millimeters with rectilinear slits of approximately 4 millimeters in length at a density of 9 slits per square centimeter, where the slits are arranged parallel to one another but staggered.

The size of the film bag and quantity of its contents, just as the external shape of the film bag, are in general determined by the size of the laundry drying apparatus and the quantity of moist laundry envisaged for one load of the equipment. The bag and contents are expediently so dimensioned that one full bag suffices for the optimum finishing treatment of one load of laundry. After the treatment, the bag is in general completely empty and can be dealt with like usual packaging waste.

The pastelike effective substance composition consists generally of an aqueous dispersion of the effective substance or of several effective substances with an effective substance content of generally more than 10% by weight and up to 80% by weight of the paste. Especially in the case of the softening and antistatic effective substances, the content of effective substances will be from 15% to 50% by weight of the paste. Since by far the greatest part of the effective substances coming to be considered for the finishing treatment of laundry are difficult to dissolve in water, an aqueous effective substance paste can generally be prepared in a simple manner by mixing the effective substance with water and adjusting the paste to the desired consistency. With effective substances, which are particularly difficult to dissolve, it is recommended that a dispersing agent and/or a water-soluble organic solvent of the group of the lower alkanols, alkoxyalkanols and alkanediols, all possessing 1 to 6 carbon atoms, be added. Such organic solvents can be contained in minor quantities, of from 0 to 5% by weight, in the effective substance paste. These organic solvents, for example, isopropyl alcohol, may also already be present as a constituent of the commercially conventional effective substance to improve its self life and workability.

In the case that a substance, which is easily soluble in water is to be utilized as an effective substance and which does not form a paste or a gel of desired consistency directly with water, a thickening agent compatible with the textiles, such as starch, for example, may be added. In general, however, such easily soluble and highly fluid effective substances are usually made up together with the other effective substances which are difficult to dissolve in water, for example, with a textile softener. so that in general the addition of a special thickening agent is superfluous.

A perfume oil emulsion, consisting of the perfume oil, water and an emulsifying agent, such as a nonionic surface-active compound, for example, fatty alcohol polyoxyethylene glycol ether may also be added to the actual effective substance paste. Such effective substance pastes, additionally provided with scent, enable an odor promoting the impression of cleanliness and freshness to be imparted to the dried laundry. Flowery-scented essences are mostly selected as perfume oils for this, such as are also usual in the laundry finishing treatment agents hitherto used in rinsing.

As indicated above, it is preferable to make the film bag in such a manner that the perfume oil emulsion are separated from the paste of effective substance or substances.

The laundry treatment finishing agent of the invention may expediently be enclosed, during transportation and storage until use, in an aroma-impermeable surrounding package, for example, of aluminum foil, so that the smell of the perfume of the filled film bag is kept away from its surroundings. A surrounding package of this kind is to be recommended also for non-perfumed forms of the agent as protection for the pressure-sensitive, slit film front side and also as a carrier for texts and pictures.

In principle, all substances suitable for textile finishing treatment, which are capable of being converted into aqueous paste form, are suitable as effective substances for use in the agent. In particular, textile-softening and textile antistatic-making substances, antimicrobic substances and agents for laundry disinfection are of particular interest. These effective substances may be used individually or as one or more mixtures in the form of aqueous pastes, since in the form of the aqueous paste, these effective substances are able to be combined in any desired manner without it being necessary to consider substrate-specific or substance-specific peculiarities as is required for the known textile treatment agents for laundry driers, especially in the case of impregnated sheets, sprays or solid forms. In other words, the formulation as a paste, by comparison with solid mixtures or solutions, is less critical and permits a greater diversity of combinations.

Embodiments of the present invention will now be more particularly described by wa y of example with reference to the accompanying drawings, in which:

FIGS. 1*a* and 1*b* show in cross-section the laundry treatment finishing agent embodying the present invention;

FIG. 2 shows in plan view a film bag of the preferred shape and with a preferred arrangement of slits shown partially in one side thereof, and FIGS. 3 to 5 show cross-sectional views of further embodiments with the preferred additional perfume carriers.

Referring now particularly to FIGS. 1*a*, 1*b* and 2 of the accompanying drawings, a paste of an effective substance or substances 2 is provided in a flat layer on a impermeable rear side film 3. A film 1 provided with slits 6 lies thereover. As shown in FIG. 1*b*, the rear side 3 is preferably formed as a two-layer film 3' and 3'', wherein the film 3' lies on the inward side and preferably consists of polyethylene. With this arrangement as shown in FIG. 1*b*, the rear side 3 is preferably bonded (substance-lockingly joined) to the front side 1 along a circumferential seam 4, particularly by welding. In the cases in which two different materials meet in the films 1 and 3 at the seam 4, gluing mostly comes into consideration for the manner of closure. FIG. 2 partially shows the preferred arrangement of slits 6 in the film 1. The slits 6 extend across the entire surface of film 1.

The cross-section of the preferred bag with additional perfume carriers is shown by the FIGS. 3, 4 and 5; their plan view agrees with that of FIG. 2.

FIG. 3 shows an arrangement of the film bag with a perfume oil carrier 5, which comprises a non-woven fabric soaked with a perfume oil emulsion and lies directly against the rear side 3, which is impermeable to the effective substance and perfume. The aqueous effective substance paste 2 is arranged as a flat layer over the perfume oil carrier 5 and is closed off outwardly by the slit film 1. In this embodiment, the perfume oil emulsion is given off gradually from its carrier whereas the paste of effective substances is rapidly exhausted.

In FIG. 4, the perfume oil carrier 5 and effective substance paste 2 are arranged to be separated by the sheet 3. As in the other illustrations, the paste 2 is closed off outwardly by the slit film 1. The perfume oil carrier 5 is covered outwardly by a plastics film 7, which is impermeable to perfume oil at room temperature and which becomes permeable at increased temperatures as used during the operating of the drier, for example, a polyethylene foil of thickness 0.05 to 0.15 millimeters, in particular 0.07 to 0.11 millimeters.

FIG. 5 represents a combination of the embodiments of FIGS. 3 and 4. A carrier 5, soaked in perfume oil, is arranged below or behind the effective substance paste 2, but separated from this by the plastics film 7, which under the conditions of mechanical laundry drying is permeable to the perfume oil. The perfume oil carrier 5 in that case lies on the internal surface of the rear side foil 3. By this arrangement, the delivery of perfume oil is additionally delayed, so that especially pronounced perfume effects are obtained thereby on the treated laundry.

According to FIG. 2, the preferred film bag is shown to be square, but the film bag may, of course, alternatively be of some other geometrical shape, for example, a rectangle, triangle, hexagon, or indeed any polygon, or a circle, ellipse or oval.

Particularly suitable as textile-softening effective substances are the quaternary ammonium compounds with preferably two long-chain, preferably saturated aliphatic residues each with 14 to 26, preferably 16 to 20, carbon atoms and at least one quaternary nitrogen atom in the molecule. The long chain aliphatic residues are preferably alkyl or alkenyl groups with 14 to 26 carbon atoms and may have straight or branched chains and are obtained from fatty acids or fatty amines, Guerbet amines (aliphatic amines with branched alkyl groups as obtained by the Guerbet reaction on alcohols), or from the alkylamines obtained by reduction of nitroparaffins. The quaternary ammonium compounds are particularly derivatives of ammonia, i.e., the quaternary salts obtainable by alkalating long chain secondary amines. These compounds have the formula:

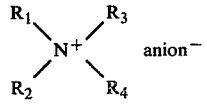

where $R_1$ and $R_2$ are alkyl having 1 to 4 carbon atoms or alkylol having 2 to 4 carbon atoms, $R_3$ and $R_4$ are alkyl or alkenyl or mixtures thereof, with 14 to 26 carbon atoms and anion$^-$ is the anion of a mineral or organic sulfonic acid, such as, for example, the distearyl dimethyl ammonium chloride or ditallow-alkyl dimethyl ammonium chloride; or the imidazoline compounds having the formula:

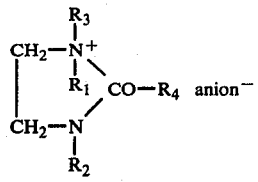

where $R_1$ and $R_2$ are alkyl having 1 to 4 carbon atoms or alkylol having 2 to 4 carbon atoms, $R_3$ and $R_4$ are alkyl or alkenyl or mixtures thereof, with 14 to 26 carbon atoms and anion$^-$ is the anion of a mineral or organic sulfonic acid, which are obtainable by the reaction of 1 mol of an amino alkyl ethylene diamine or hydroxyalkyl ethylene diamine with 2 mols of a long chain, $C_{14}$–$C_{26}$ fatty acid or its ester and which are then converted by alkylation into the quaternary imidazolinium compounds. In these quaternary ammonium compounds, the anion generally consists of the acid residue, which results from the alkylating agent used in the quaternizing. Chloride, bromide, methyl sulfate, ethyl sulfate, methane-, ethane- or toluenesulfonate, for example, come into consideration as the anion$^-$.

Besides these quaternary ammonium compounds, the condensation products of 1 to 3 mols of a higher fatty acid or higher fatty acid lower alkyl ester or ⅓ to 1 mol of a higher fatty acid triglyceride, with 1 mol of a hydroxyalkyl polyamine, for example, hydroxyethyl ethylene diamine, hydroxyethyl diethylene triamine, also come into consideration as textile softeners. Particularly suitable is the product obtainable by the reaction of 1 mol of a higher fatty acid triglyceride, especially hardened tallow, and 1 mol of hydroxyethyl ethylene diamine at 90° to 150° C.

Preferably used as a textile softener is a combination of a quaternary ammonium compound of the ammonia type with two $C_{16}$ to $C_{20}$-alkyl groups and two methyl groups in the molecule, and with the anion of chloride, bromide or methyl sulfate, in particular, ditallow-alkyl dimethyl ammonium chloride, together with the fatty acid condensation product of 1 mol of hardened tallow and 1 mol of hydroxyethyl ethylene diamine in the ratio 4:1 to 1:4 as an aqueous paste having a 15% to 50% by weight effective substance content. The aqueous pastes prepared with this combination are especially stable in storage over the entire range of concentration and mixture and lead to a uniform and notable improvement in the feel of the treated textiles without formation of stains.

For the antistatic producing effective substances, generally the same types of compounds are concerned as those which also exhibit a textile softening effect. In addition to the already described quaternary ammonium compounds and fatty acid condensation products, quaternary ammonium compounds with one long chain and three short chain aliphatic residues are also suitable as textile antistatic agents. These have the same formula as the quaternary ammonium compounds given above but where $R_3$ is replaced by $R_2$. Further suitable antistatic agents are, for example, the products of the reaction of 1 mol of an aliphatic $C_6$ to $C_{20}$ alcohol, preferably an alkanol or alkenol, and more than 20 mols, preferably 35 to 50 mols, of ethylene oxide.

The suitable antimicrobic active substances, i.e., bactericidally or bacteriostatically or fungicidally or fungistatically active compounds, are also mostly the quaternary ammonium compounds as above, especially those which, in addition to one long chain aliphatic and two short chain aliphatic hydrocarbon residues, also contain an aromatic residue, linked by an aliphatic carbon atom with the nitrogen atom, or an aliphatic organic residue displaying double bonds in the molecule. These compounds have the same formula as the quaternary ammonium compounds given above, but where $R_3$ is benzyl, substituted benzyl, methylnaphthyl, alkylcyclohexyl or alkenyl having 3 to 6 carbon atoms.

Typical representatives of such antimicrobic active substances are the compounds dimethyl benzyl dodecyl ammonium chloride or dibutyl allyl dodecyl ammonium chloride and ethyl cyclohexyl allyl dodecyl ammonium chloride. Useful antimicrobic active substances are also the brominated nitro alcohols, particularly bromonitroalkanols and bromonitroalkanediols, both having 3 to 8 carbon atoms, such as the compounds 2-brome-2-nitropropane-1,3-diol, 1-brome-1-nitro-3,3-trichloro-2-propanol, and 2-brome-2-nitrobutanol. Also suitable as antimicrobic active substances are halogenated and/or trifluoromethyl substituted phenolic compounds, especially the halogenated salicylanilides, for example, the compounds dibromo- and tribromosalicylanilide, as well as derivatives of p-phenoxyphenol, such as, for example, the compound 2-hydroxy-2',4,4'-trichlorodiphenyl ether. These antimicrobic active substances are, in general, also conserving agents for the active substance paste. Additionally to or in their place, further usual conserving agents may, however, also be used for the protection of the aqueous active substance paste, such as, for example, formalin, potassium fluoride and sodium fluoride, etc.

Suitable dispersing agents which may be included with the effective substances are particularly compounds of the type of the nonionic tensides or surface-active compounds, i.e., products which owe their hydrophilic properties to the presence of polyether chains, amino, oxide, sulfoxide or phosphinoxide groups, alkylolamide groups or, for example, a large number of hydroxyl groups, and which in addition to this hydrophilic residue also contain a hydrophobic residue, which mostly consists of an aliphatic or alkyl aromatic hydrocarbon residue with 8 to 26, especially 12 to 18, carbon atoms. Belonging to the nonionic tensides suitable as dispersing agents are primarily the adduction products of 4 to 40, preferably 4 to 20, mols of ethylene oxide onto 1 mol of an aliphatic $C_{10}$ to $C_{20}$ alcohol (alkenol or alkanol), or of a $C_6$ to $C_{18}$ alkyl phenol, a higher fatty amine or a higher fatty acid, both of a $C_{10}$ to $C_{20}$ carbon chain length. Particularly preferred are the ethoxylated higher fatty alcohols, particularly coconut or tallow fatty alcohols and oleyl alcohol and as well as the ethoxylated products of the oxo alcohols and secondary alcohols of the corresponding chain lengths.

Further suitable dispersing agents are the watersoluble addition products, containing 20 to 250 ethylene glycol ether groups and 10 to 100 propylene glycol ether groups, of ethylene oxide adducted either onto polyoxypropylene glycol or onto alkylene diamine polyoxypropylene glycol or onto alkylene polyoxypropylene glycols with 1 to 10 carbon atoms in the alkylene group, in which the polypropylene glycol chain functions as a hydrophobic residue.

The invention is more closely explained by the following examples which are not limitative in any respect.

EXAMPLE 1

This example relates to a film bag with textile softening active substance and to its manufacture. For the production of the film bag, a piece of two-layer foil of aluminum/polyethylene of the size 10 × 10 cm is welded at three sides to an equally large piece of a slit polyethylene film with nine slits per square centimeter and a slit length of four millimeters, the thickness of this sheet being 250 microns. The film bag was filled with 12 gm of an aqueous paste containing 19% of ditallow-alkyl dimethyl ammonium chloride and then the fourth edge was likewise welded. The thus-obtained, cushion-shaped bag had a weight of 15.2 gm (3.2 gm film + 12 gm filling). The size and quantity of contents of this bag were so dimensioned that one bag was sufficient for one load of a household laundry drier (2.8 kg of dry laundry).

To demonstrate the textile-softening action, a laundry loading of terry towelling fabric, which had been washed with a commercially conventional complete washing agent in a household washing machine and which had become hardened by 96 washings, was dried in the laundry drier and then the feel or handle was assessed independently by four persons and given marks from 1 (full and very soft feel) to 6 (very hard feel). The feel mark "1" related to new cotton terry towelling fabric, which after removing the finish dressing had been treated with a solution of 0.5 gm per liter of ditallow-alkyl dimethyl ammonium chloride, whereas feel mark 6 related to the very hard terry towelling fabric which after 96 boiling washes in an automatic washing machine had been hung up to dry. Additionally, smooth polyester/cotton fabric (65/35) was washed and dried together with this to determine the electrostatic charge. The feel assessments and also the elctrostatic measurements were carried out after the laundry finishing treatment in the laundry drier, namely:

(a) without any finishing treatment agent;

(b) with use of a conventional laundry soft rinsing agent in the last rinsing bath of the washing machine (3 gm effective substance);

(c) with a non-woven paper fabric soaked in effective substance and dispersing agent (2.9 gm of quaternary ammonium compound + 0.7 gm dispersing agent per 654 square centimeters of non-woven paper fabric −1.3 gm), and (d) with an agent exemplifying the present invention.

The numerical values obtained in the comparison are given in Table I below. The feel marks given are average values from five assessments each by four testing persons and the electrostatic measurement values are average values of five measurements of the field strength in kilovolts per centimeter measured with a statometer.

TABLE I

| Average values of five assessments | (a) Without effective substance | (b) Finishing treatment of the laundry in the rinsing bath with about 3 gm of effective substance | (c) Impregnated non-woven fabric with 2.9 gm per 645 square centimeter | (d) Agent exemplifying the invention with about 2.4 gm of effective substance |
|---|---|---|---|---|
| Feel of towelling fabric previously washed 96 times | 3.6 | 2.3 | 3.3 | 2.4 |
| Electrostatic charge on polyester/cotton fabric in kilovolts per centimeter | 12.9 | 5.5 | 2.2 | 1.3 |

From the numerical values of the Table, the superior effectiveness of the agent exemplifying the invention is clearly apparent. Accordingly, the softening action obtained by a soft rinse in the last rinsing bath was attained by the agent exemplying the invention practically already with the use of smaller quantities of effective substance and the antistatic effect was exceeded by far. Clearly exceeded were also the achievable textile softening action and textile antistatic effects obtainable with the softening non-woven fabric of the state of the art.

EXAMPLE 2

This example relates to an agent containing the textile-softening substance in combination with a perfume oil emulsion. The size and construction of the film bag are as in Example 1. The weight of the filled bag was 18.2 gm (3.2 gm bag + 15 gm filling). The quantity of filling of 15 gm consisted of 2.25 gm of ditallow-alkyl dimethyl ammonium chloride, 9.75 gm of water and 3 gm of a perfume oil emulsion, which was composed of 60 parts of perfume oil, 5 parts of dispersing agent (coconut fatty alcohol ethoxylated with 4 mols ethylene oxide), and 35 parts of water.

The perfume oil employed was a fragrance which can be described as "flowery fancy lavender with a radiant fresh headnote" and had the following composition:

| | Percent by weight |
|---|---|
| Lavender oil 40/42% | 350 |
| Lavendin oil 30/32% | 280 |
| Italian lemon oil | 100 |
| Rosemary oil | 80 |
| Geranium oil | 50 |
| Terpineol (perfumery) | 50 |
| α-Hexyl cinnamaldehyde | 50 |
| Patchouli oil Karimun | 20 |
| Ketone musk | 20 |

2.8 kg of dry laundry, consisting of ⅔ of smooth textiles and ⅓ of terry towelling textiles, were used. The proportion of terry towelling was pretreated as in Example 1. For determination of the softening effect, the same procedure was used as in Example 1. The electrostatic measurements were carried out on textile strips of polyester/cotton (65/35), in that a voltage of 80 V was applied and then conducted away through an electrode. The time in seconds, in which the voltage decreased to 40 V was then measured. This half-value time is given in the following Table II, wherein lower values are an expression of good antielectrostatic properties of the treated textiles. Additionally, the odor of the laundry after drying was assessed by analogy with the assessment of feel (four testing persons, average values of five assessments), wherein marks were awarded ranging from 0 = no odor of perfume to 4 = very strong perfume odor.

TABLE II

| Average values of five assessments | (a) Without effective substance | (b) Finishing treatment of laundry in the rinsing bath with about 3 gm of effective substance | (c) Impregnated non-woven fabric with 2.9 gm per 645 square centimeter | (d) Agent exemplifying the invention with about 2.25 gm of effective substance |
|---|---|---|---|---|
| Feel of terry towelling fabric previously washed 96 times | 3.6 | 1.8 | 3.2 | 2.6 |
| Half-value time in seconds | 11.2 | 7.8 | 8.8 | 4.3 |
| Odor of laundry | 0 | 0 | 1.0 | 1.9 |

The numerical values of Table II indicate the clear superiority of the agent exemplifying the invention. Comparisons were made with known finishing treatment agents as in Example 1, which had been perfumed.

EXAMPLE 3

A film bag was filled as in Examples 1 and 2 with 15 gm of a paste of the following composition:

| | Percent by weight |
|---|---|
| The condensation product of 1 mol of hardened tallow and 1 mol of hydroxyethyl ethylene diamine | 7.5 |
| Ditallow-alkyl dimethyl ammonium chloride | 7.5 |
| Perfume oil emulsion (see Example 2) | 16.7 |
| Water | 68.3 |

The textiles treated with this agent gave similarly good results in the tests carried out as in Example 2.

EXAMPLE 4

This example relates to an agent containing the textile-softening effective substance in combination with a perfume oil emulsion deposited on a polyamide fleece separated from the paste of effective substance by a plastic film according to FIG. 5 which is impermeable to perfume oil at room temperature and which becomes permeable at increased temperatures as used during the operating of the drier.

For the production of the film bag, a piece of two-layer foil of aluminum/polyethylene of the size 10 × 10 cm is welded on three sides to an equally large size of a polyethylene film with a thickness of 0.08 mm. A polyamide fleece, having a weight per square meter of about 150 gm, 7.5 × 7.5 cm was impregnated with 3 gm of the perfume oil emulsion of Example 2 and inserted in the film bag. The fourth side of this film bag was then welded. A piece of slit polyethylene film 10 × 10 cm was then welded on three sides on top of the polyethylene film side. The slit polyethylene film had nine slits per square centimeter, a slit length of 4 millimeters and thickness of film of 250 microns, to form a second film bag. This second film bag was filled with 12 gm of an aqueous paste containing 19% of ditallow-alkyl dimethyl ammonium chloride and the fourth side was welded.

The combination bag had a size and quantity of contents sufficient to treat one load of a household laundry drier of 2.8 kilograms of dry laundry. The textile softening effect of the combination agent and the antistatic effect was comparable to that of Example 1.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A laundry finishing treatment agent for use in a mechanical laundry drier comprising a paste of at least one effective substance selected from the group consisting of:

(1) textile fabric softeners,
(2) textile antistatic agents,
(3) mixtures of (1) and (2),
(4) mixtures of (1) and (2) or both with a disinfectant agent,
(5) mixtures of (1) or (2) or both with a laundry odorant, and
(6) mixtures of (1) or (2) or both with a disinfectant agent and a laundry odorant, said at least one effective substance being present in an amount sufficient to treat the average laundry processed in said mechanical laundry drier and being mixed with water containing from 0 to 5% by weight of an organic solvent to give said paste, contained in an article of film material having a pillow-like form with one side impermeable to said paste of said effective substance and the other side being a plastic film having a plurality of slits therein of such dimensions, that at room temperature and in the absence of pressure on said article, said slits are substantially closed and obstruct the issuance of said paste from said article.

2. The laundry treatment finishing agent of claim 1 wherein said paste of at least one effective substance also comprises an auxiliary aid selected from the group consisting of nonionic surface-active compounds, water-soluble organic solvents and mixtures thereof.

3. The laundry treatment finishing agent of claim 1 wherein said plastic film has from 4 to 20 slits per square centimeter.

4. The laundry treatment finishing agent of claim 3 wherein said plastic film has from 6 to 10 slits per square centimeter.

5. The laundry treatment finishing agent of claim 1 wherein said plastic film is polyethylene.

6. The laundry treatment finishing agent of claim 3 wherein the slits in said plastic film are arranged rectilinearly in parallel rows displaced relative to one another.

7. The laundry treatment finishing agent of claim 1 wherein said paste of at least one effective substance contains from 10% to 80% by weight of said at least one effective substance.

8. The laundry treatment finishing agent of claim 7 wherein said paste of at least one effective substance contains from 15% to 50% by weight of said at least one effective substance.

9. The laundry treatment finishing agent of claim 1 wherein said at least one effective substance is a member selected from the group consisting of quaternary ammonium compounds, quaternary imidazolinium compounds, and condensation products of higher fatty acid compounds with a hydroxyalkyl polyamine.

10. The laundry treatment finishing agent of claim 1 wherein said at least one effective substance includes a laundry odorant.

11. The laundry treatment finishing agent of claim 10 wherein said laundry odorant is a perfume oil emulsion deposited on a porous sheet-like carrier adjacent said impermeable side.

12. The laundry treatment finishing agent of claim 10 wherein said laundry odorant is a perfume oil emulsion deposited on a porous sheet-like carrier and said carrier is disposed on the opposite of said impermeable side from said paste of at least one effective substance and is enclosed in a plastic film which is impermeable to perfume oil at room temperature and which becomes permeable at increased temperatures as used during the operating of the drier.

13. The laundry treatment finishing agent of claim 10 wherein said laundry odorant is a perfume oil emulsion deposited on a porous sheet-like carrier adjacent said impermeable side and separated from said paste of at least one effective substance by a plastic film which is impermeable to perfume oil at room temperature and which becomes permeable at increased temperatures as used during the operating of the drier.

14. The laundry treatment finishing agent of claim 12 wherein said plastic film is a polyethylene film having a thickness of from 0.05 to 0.15 mm.

15. The laundry treatment finishing agent of claim 13 wherein said plastic film is a polyethylene film having a thickness of from 0.05 to 0.15 mm.

16. The laundry treatment finishing agent of claim 1 wherein said at least one effective substance is ditallow-alkyl dimethyl ammonium chloride.

17. The laundry treatment finishing agent of claim 1 wherein said at least one effective substance is a combination of a di-$C_{16}$-$C_{20}$-alkyl dimethyl ammonium compound with an anion selected from the group consisting of chloride, bromide and methyl sulfate and a condensation product of 1 mol of hardened tallow with 1 mol of hydroxyethyl ethylene diamine in a ratio of 4:1 to 1:4, with a content of from 10% to 30% by weight of said combination in said aqueous paste.

* * * * *